US011369850B2

(12) United States Patent
Regalado

(10) Patent No.: US 11,369,850 B2
(45) Date of Patent: Jun. 28, 2022

(54) GOLF CADDY TOOL ASSEMBLY

(71) Applicant: Tomas Regalado, San Antonio, TX (US)

(72) Inventor: Tomas Regalado, San Antonio, TX (US)

( * ) Notice: Subject to any disclaimer, the term of this patent is extended or adjusted under 35 U.S.C. 154(b) by 134 days.

(21) Appl. No.: 16/942,254

(22) Filed: Jul. 29, 2020

(65) Prior Publication Data

US 2022/0032140 A1 Feb. 3, 2022

(51) Int. Cl.

| | |
|---|---|
| ***A63B 57/30*** | (2015.01) |
| ***A63B 57/50*** | (2015.01) |
| ***A63B 57/60*** | (2015.01) |
| ***A63B 47/04*** | (2006.01) |
| ***A46B 15/00*** | (2006.01) |
| ***A46B 7/02*** | (2006.01) |
| ***A46B 5/02*** | (2006.01) |

(52) U.S. Cl.

CPC ..... *A63B 57/353* (2015.10); *A46B 5/02* (2013.01); *A46B 7/023* (2013.01); *A46B 15/0055* (2013.01); *A63B 47/04* (2013.01); *A63B 57/50* (2015.10); *A63B 57/60* (2015.10); *A46B 2200/306* (2013.01); *A46B 2200/3073* (2013.01); *A63B 2209/08* (2013.01)

(58) Field of Classification Search

CPC ..... A63B 57/50; A63B 57/353; A63B 57/60; A63B 2209/08; A63B 47/04; A46B 5/02; A46B 7/023; A46B 15/0055; A46B 2200/306; A46B 2200/3073

See application file for complete search history.

(56) References Cited

U.S. PATENT DOCUMENTS

| | | | | | |
|---|---|---|---|---|---|
| 3,298,579 | A | | 1/1967 | Smith | |
| 3,360,807 | A | * | 1/1968 | Mauck | A63B 57/50 30/169 |
| 3,456,737 | A | * | 7/1969 | Rhyme | A63B 57/50 172/381 |
| 3,539,017 | A | * | 11/1970 | Johnson | A63B 57/50 30/322 |
| 4,736,877 | A | | 4/1988 | Clark | |
| 4,862,970 | A | * | 9/1989 | Hlavacek | A63B 57/50 473/286 |
| 4,998,726 | A | * | 3/1991 | Budnick | A63B 71/0672 172/371 |
| 5,388,824 | A | * | 2/1995 | Reimers | A63B 57/207 473/406 |
| 5,449,169 | A | * | 9/1995 | Hardin | A63B 57/50 473/408 |
| 5,562,553 | A | * | 10/1996 | Digerness | A63B 57/353 473/406 |

(Continued)

FOREIGN PATENT DOCUMENTS

| | | | | |
|---|---|---|---|---|
| EP | 1004334 A1 | * | 5/2000 | A63B 57/0037 |
| KR | 1737441 B1 | * | 5/2017 | A01B 45/02 |
| WO | WO-2006034155 A1 | * | 3/2006 | A46B 7/023 |

*Primary Examiner* — Steven B Wong

(57) ABSTRACT

A golf caddy tool assembly for fulfilling a variety of maintenance needs for the game of golf includes a handle that has a recess integrated therein. A ball marker is removably positionable in the recess for marking the location of a golf ball on a golf course. A divot fork is slidably coupled to the handle for lifting and repairing divots in the golf course. A brush is slidably coupled to the handle for scrubbing implements for playing golf.

11 Claims, 5 Drawing Sheets

(56) References Cited

U.S. PATENT DOCUMENTS

| | | | | | |
|---|---|---|---|---|---|
| 5,586,674 | A * | 12/1996 | Nachbauer | A63B 55/406 | 206/315.3 |
| 5,799,853 | A * | 9/1998 | Brewster | A63B 57/207 | 224/679 |
| 6,095,934 | A | 8/2000 | Ohama | | |
| 6,193,121 | B1 | 2/2001 | Chang | | |
| 6,220,973 | B1 * | 4/2001 | Hsu | A63B 57/203 | 473/406 |
| 6,256,840 | B1 * | 7/2001 | Elliott | A63B 57/60 | 24/3.11 |
| 6,413,174 | B1 * | 7/2002 | Roberts | A63B 57/353 | 473/408 |
| 6,428,430 | B1 * | 8/2002 | Chong | A63B 57/60 | 473/406 |
| 6,769,587 | B1 | 8/2004 | Lomas | | |
| 6,837,807 | B1 * | 1/2005 | Kerr | A01B 1/24 | 473/286 |
| 8,573,457 | B1 | 11/2013 | Morgan | | |
| 9,539,480 | B1 * | 1/2017 | Boswell | A63B 57/207 | |
| 2003/0109336 | A1 * | 6/2003 | Taylor | A63B 57/50 | 473/408 |
| 2004/0178095 | A1 | 9/2004 | Mora | | |
| 2005/0070380 | A1 * | 3/2005 | Miller | A63B 57/50 | 473/406 |
| 2009/0098952 | A1 * | 4/2009 | Leiber | A63B 57/50 | 473/408 |
| 2010/0022330 | A1 * | 1/2010 | Rourke | A63B 57/207 | 224/269 |
| 2010/0099519 | A1 * | 4/2010 | Leiber | A63B 57/50 | 473/409 |
| 2010/0323823 | A1 * | 12/2010 | Halsey | A63B 57/207 | 473/406 |
| 2011/0081994 | A1 * | 4/2011 | Rourke | A63B 57/353 | 473/408 |

* cited by examiner

GOLF CADDY TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to caddy tool devices and more particularly pertains to a new caddy tool device for fulfilling a variety of maintenance needs for the game of golf.

(2) Description of Related Art Including Information Disclosed Under 37 CFR 1.97 and 1.98

The prior art relates to caddy tool devices including a housing for holding a pair of golf tees and a ball marker that is attachable to a user's belt. The prior art discloses a plate that has a plurality of holders mounted thereon for holding golf tees and a divot fork and which is wearable on a user's belt. The prior art discloses a retractable divot fork for repairing golf divots. The prior art discloses a golf storage device for storing golf tees, a divot fork, ball markers and a hand towel. The prior art discloses a golf storage device that has a divot fork and a brush each being suspended on a storage hook. The prior art discloses a variety of wearable storage devices for storing a plurality of golf tees.

BRIEF SUMMARY OF THE INVENTION

An embodiment of the disclosure meets the needs presented above by generally comprising a handle that has a recess integrated therein. A ball marker is removably positionable in the recess for marking the location of a golf ball on a golf course. A divot fork is slidably coupled to the handle for lifting and repairing divots in the golf course. A brush is slidably coupled to the handle for scrubbing implements for playing golf.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
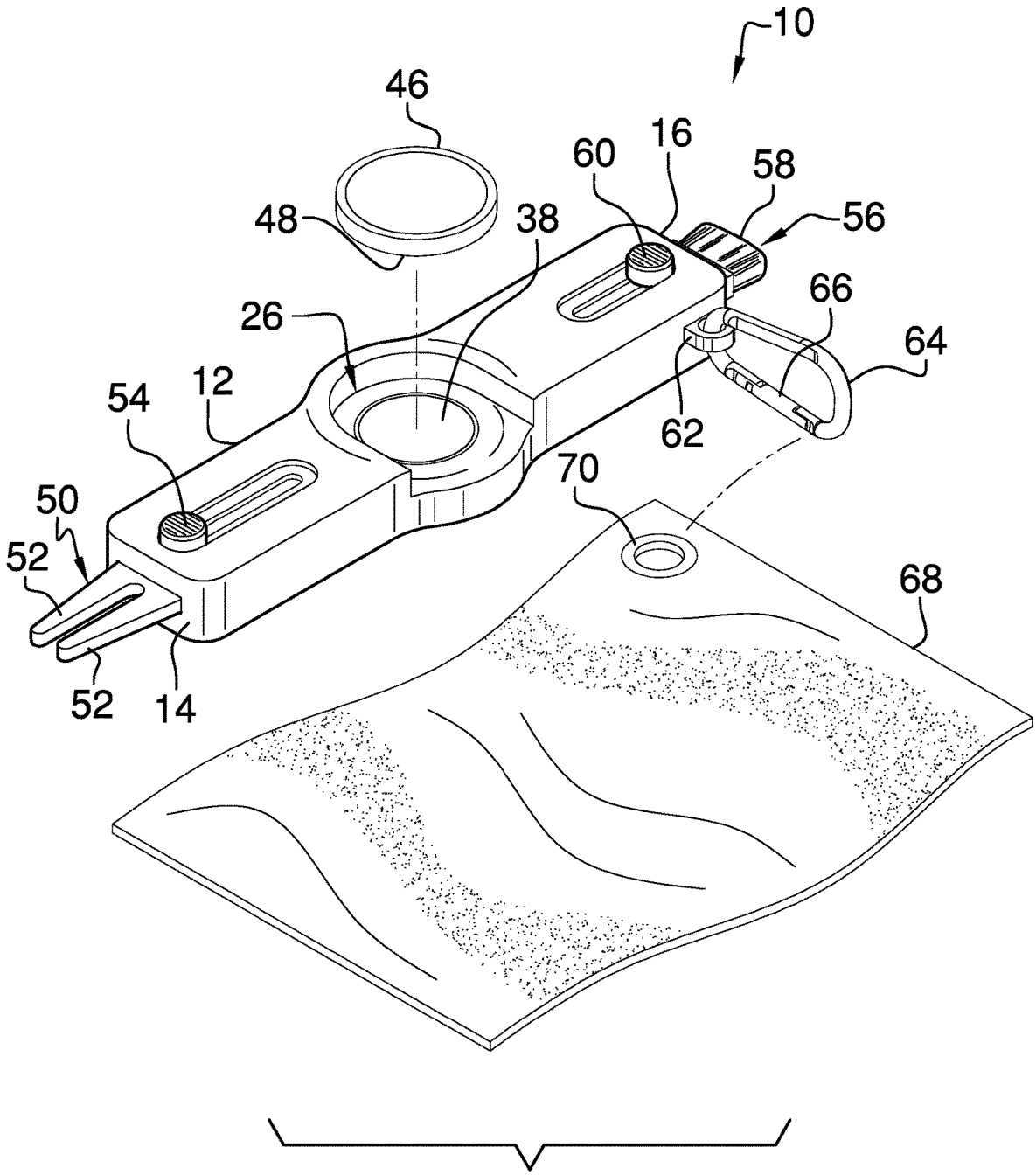
FIG. 1 is a perspective view of a golf caddy tool assembly according to an embodiment of the disclosure.
Figure 2:
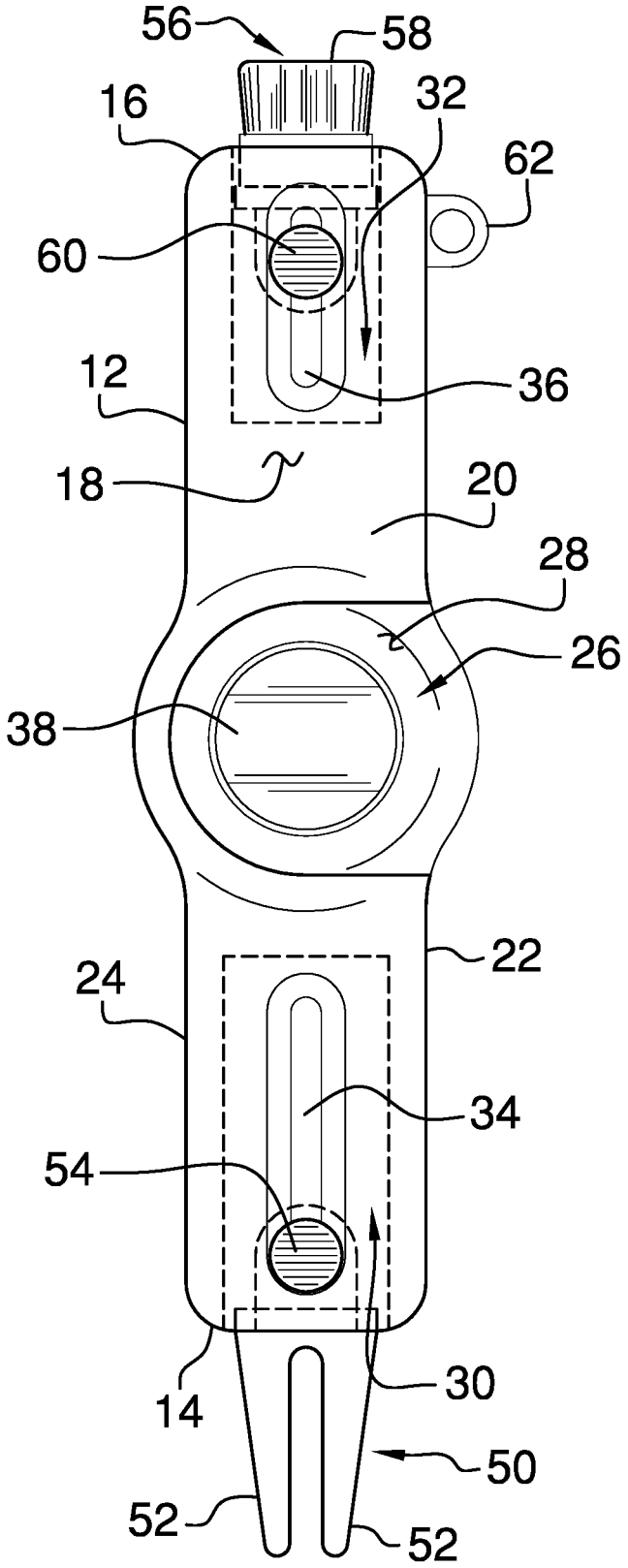
FIG. 2 is a top phantom view of an embodiment of the disclosure.
Figure 3:
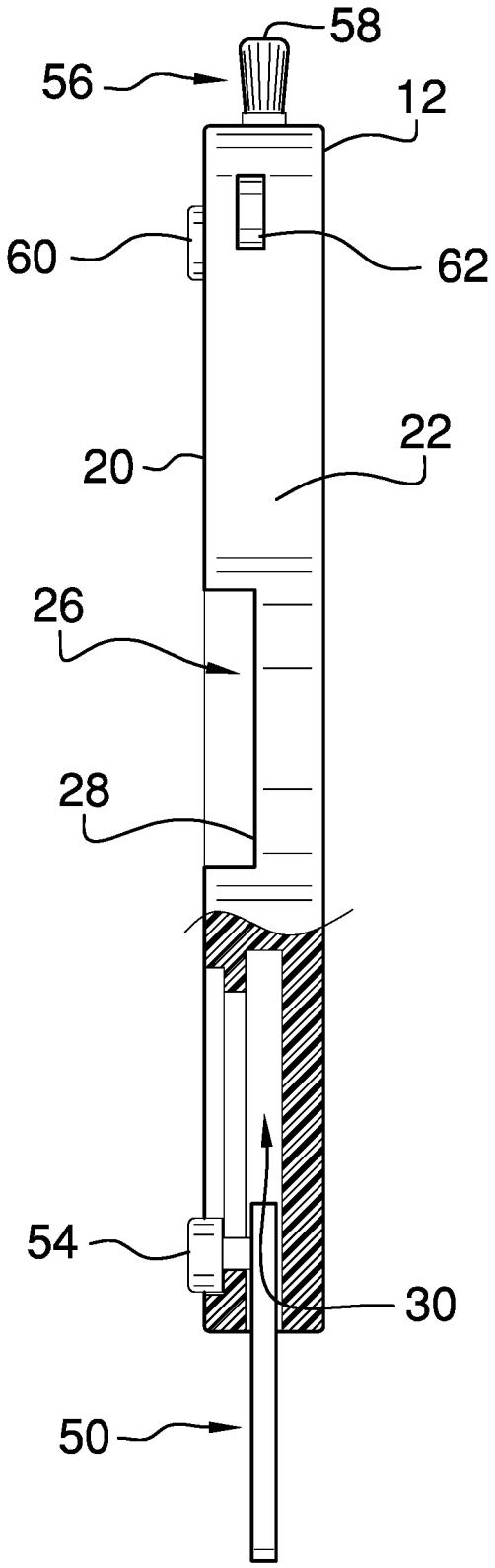
FIG. 3 is a front cut-away view of an embodiment of the disclosure.
Figure 4:
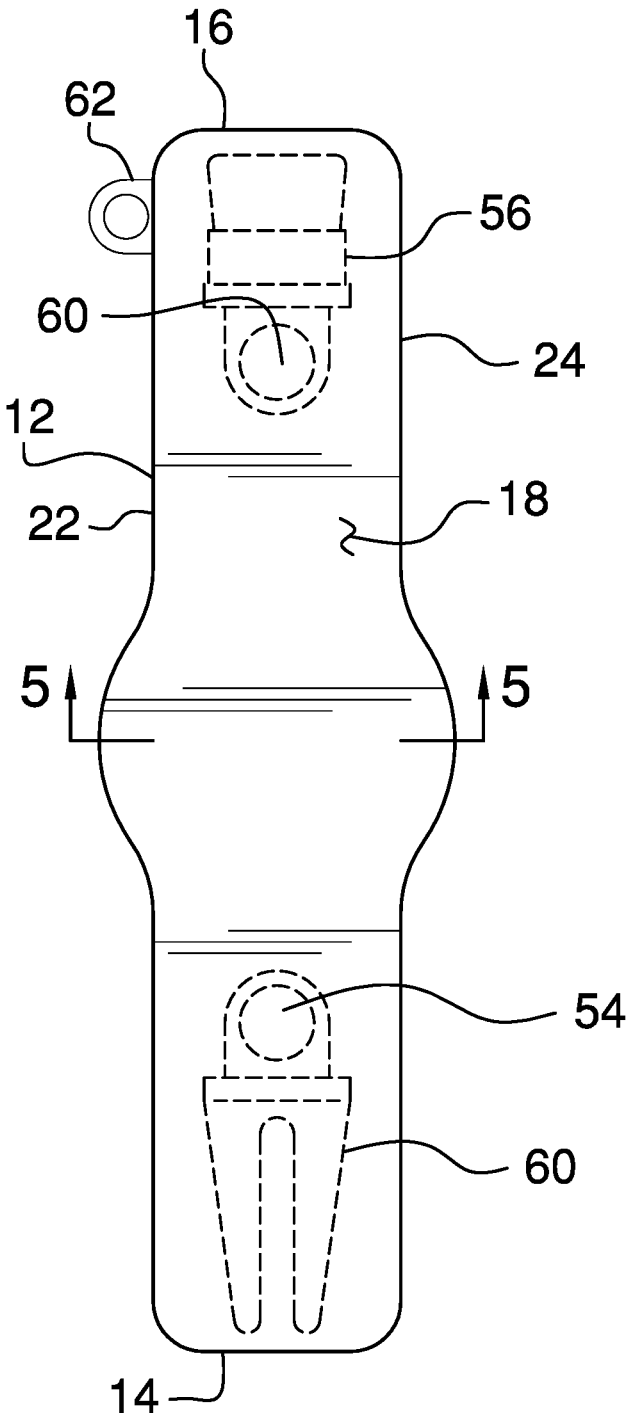
FIG. 4 is a bottom phantom view of an embodiment of the disclosure.
Figure 5:
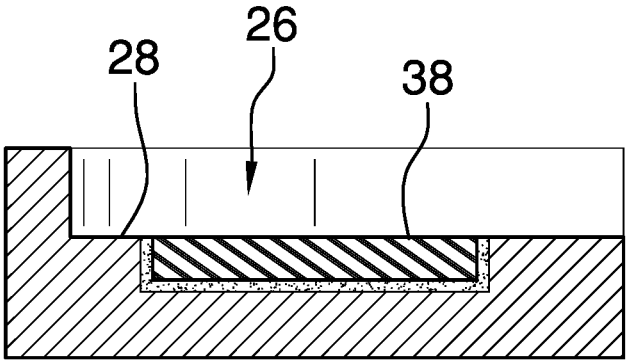
FIG. 5 is a cross sectional view taken along line 5-5 of FIG. 4 of an embodiment of the disclosure.
Figure 6:
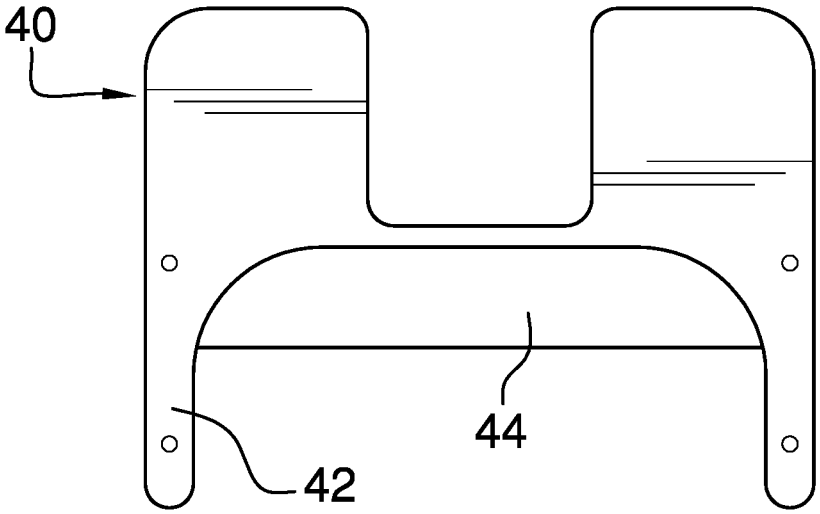
FIG. 6 is a back view of belt clip of an embodiment of the disclosure.

With reference now to the drawings, and in particular to FIGS. 1 through 6 thereof, a new caddy tool device embodying the principles and concepts of an embodiment of the disclosure and generally designated by the reference numeral 10 will be described.

As best illustrated in FIGS. 1 through 6, the golf caddy tool assembly 10 generally comprises a handle 12 that has a first end 14, a second end 16 and an outer surface 18 extending therebetween. The handle 12 is elongated between the first end 14 and the second end 16, and the outer surface 18 has a top side 20, a front side 22 and a back side 24. The top side 20 has a recess 26 therein and the recess 26 intersects the front side 22. Moreover, the recess 26 is centrally positioned between the first end 14 and the second end 16, and the recess 26 has a lower bounding surface 28. The recess defining a wall extending up from the lower bounding surface. The wall has straight outer portions and a curved medial portion extending between the straight outer portions. The straight outer portions are parallel and perpendicular to a central longitudinal axis of the handle. Each of the front side 22 and the back side 24 of the outer surface 18 are rounded outwardly about a center point of the recess 26 for accommodating the diameter of the recess 26.

The first end 14 has a first well 30 extending toward the second end 16 and the second end 16 has a second well 32 extending toward the first end 14. The top side 20 has a first slot 34 extending into the first well 30 and the first slot 34 is oriented collinear with the first well 30. The top side 20 has a second slot 36 extending into the second well 32 and the second slot 36 is oriented collinear with the second well 32. A magnet 38 is provided and the magnet 38 is integrated into the lower bounding surface 28 of the recess 26. As is most clearly shown in FIG. 6, a belt clip 40 is provided that can be mounted to the handle 12 for hanging the handle 12 on a belt worn on the user's waist or other type of support. The belt clip 40 may have a mounting portion 42 that is fastenable to the handle 12 and a gripping portion 44 that is offset from the mounting portion 42 for sliding behind a belt or other type of support.

A ball marker 46 is removably positionable in the recess 26 such that the ball marker 46 is accessible to mark the location of a golf ball on a golf course. The ball marker 46 has a bottom surface 48 and the bottom surface 48 abuts the lower bounding surface 28 of the recess 26 when the ball marker 46 is positioned in the recess 26. The bottom surface 48 is comprised of a magnetic material thereby facilitating the magnet 38 to retain the ball marker 46 in the recess 26. The ball marker 46 may be structured in a manner similar to existing, conventional golf ball markers. The ball marker has a thickness substantially equal to a depth of the recess. The ball marker is inset into the recess when the ball marker is positioned in the recess. The ball marker has a diameter substantially equal to a distance between the straight outer portions. The ball marker is removable from the recess by sliding the ball marker laterally between the straight outer portions.

A divot fork 50 is slidably coupled to the handle 12 for lifting and repairing divots in the golf course. The divot fork 50 is slidably positioned in the first well 30. Additionally, the divot fork 50 has a pair of tines 52 that is each exposed when the divot fork 50 is in a deployed position. Conversely, each of the tines 52 is retracted into the first well 30 when the divot fork 50 is in a stored position. A fork button 54 is coupled to the divot fork 50 and the fork button 54 extends through the first slot 34 in the top side 20 of the outer surface 18 of the handle 12. In this way the fork button 54 can be manipulated by a user to slide the divot fork 50 between the deployed position and the stored position.

A brush 56 is slidably coupled to the handle 12 for scrubbing implements for playing golf. The brush 56 is slidably positioned in the second well 32. Additionally, the brush 56 has a plurality of bristles 58 that is each exposed when the brush 56 is positioned in a stored position. Conversely, each of the bristles 58 is retracted into the second well 32 when the brush 56 is positioned in a stored position. Each of the bristles 58 may be comprised of steel or other sufficiently stiff material for scrubbing the face of golf clubs. A brush button 60 is coupled to the brush 56 and the brush button 60 extends through the second slot 36 in the top side 20 of the outer surface 18 of the handle 12. In this way the brush button 60 can be manipulated by a user to slide the brush 56 between the deployed position and the stored position.

An engagement 62 is coupled to the front side 22 of the outer surface 18 of the handle 12. A coupler 64 is provided and the coupler 64 is removably coupled to the engagement 62. The coupler 64 includes a gate 66 that is hingedly integrated therein for opening and closing the coupler 64. The coupler 64 may comprise a D-ring or other similar type of closed loop. A towel 68 is removably attachable to the coupler 64 for wiping or cleaning an object. The towel 68 has a grommet 70 extending therethrough and the coupler 64 is extendable through the grommet 70 for attaching the towel 68 to the coupler 64.

In use, the fork button 54 is manipulated to slide the divot fork 50 into the deployed position for repairing divots on a golf course. The brush button 60 is manipulated to slide the brush 56 into the deployed position for cleaning various surfaces, such as golf club faces, golf balls and soles of golf shoes. The ball marker 46 is stored in the recess 26 until such time that the user needs to mark a golf ball. Moreover, the towel 68 is available for the user at any time. In this way the user can fulfill a variety of the maintenance needs of the game of golf with a single device. Additionally, the belt clip 40 ensures that the handle 12 can be stored on the user's belt such that the handle 12 is readily accessible at all times for the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf caddy tool assembly for combining a plurality of golf related tools into a single device, said assembly comprising:

a handle having a recess being integrated therein, wherein said handle has a first end, a second end and an outer surface extending therebetween, said handle being elongated between said first end and said second end, said outer surface having a top side and a front side, said recess extending into said top side, said recess intersecting said front side, said recess being centrally positioned between said first end and said second end, said recess having a lower bounding surface, said recess defining a wall extending up from said lower bounding surface, said wall having straight outer portions and a curved medial portion extending between the straight outer portions, said straight portions being parallel and perpendicular to a central longitudinal axis of said handle, said first end having a first well extending toward said second end, said second end having a second well extending toward said first end, said top side having a first slot extending into said first well, said first slot being oriented collinear with said first well, said top side having a second slot extending into said second well, said second slot being oriented collinear with said second well;

a ball marker being removably positionable in said recess wherein said ball marker is configured to be accessible to mark the location of a golf ball on a golf course, said ball marker having a thickness substantially equal to a depth of said recess wherein said ball marker is inset into said recess when said ball marker is positioned in said recess, said ball marker having a diameter substantially equal to a distance between said straight outer portions such that said ball marker is removable from said recess by sliding said ball marker laterally between said straight outer portions;

a divot fork being slidably coupled to said handle for lifting and repairing divots in the golf course; and a brush being slidably coupled to said handle for scrubbing implements for playing golf.

2. The assembly according to claim 1, further comprising a magnet being integrated into said lower bounding surface of said recess.

3. The assembly according to claim 2, wherein said ball marker has a bottom surface, said bottom surface abutting said lower bounding surface of said recess when said ball marker is positioned in said recess, said bottom surface being comprised of a magnetic material thereby facilitating said magnet to retain said ball marker in said recess.

4. The assembly according to claim 1, wherein said divot fork is slidably positioned in said first well, said divot fork having a pair of tines each being exposed when said divot fork is in a deployed position, each of said tines being retracted into said first well when said divot fork is in a stored position.

5. The assembly according to claim 2, further comprising a fork button being coupled to said divot fork, said fork button extending through said first slot in said top side of said outer surface of said handle wherein said fork button is configured to be manipulated by a user, said fork button sliding said divot fork between said deployed position and said stored position.

6. The assembly according to claim 1, wherein said brush is slidably positioned in said second well, said brush having a plurality of bristles each being exposed when said brush is positioned in a stored position, each of said bristles being retracted into said second well when said brush is positioned in a stored position.

7. The assembly according to claim 6, further comprising a brush button being coupled to said brush, said brush button extending through said second slot in said top side of said outer surface of said handle wherein said brush button is configured to be manipulated by a user, said brush button sliding said brush between said deployed position and said stored position.

8. The assembly according to claim 1, further comprising an engagement being coupled to said front side of said outer surface of said handle.

9. The assembly according to claim 8, further comprising a coupler being removably coupled to said engagement, said coupler including a gate being hingedly integrated therein for opening and closing said coupler.

10. The assembly according to claim 9, further comprising a towel being removably attachable to said coupler for wiping or cleaning an object, said towel having a grommet extending therethrough, said coupler being extendable through said grommet for attaching said towel to said coupler.

11. A golf caddy tool assembly for combining a plurality of golf related tools into a single device, said assembly comprising:

a handle having a first end, a second end and an outer surface extending therebetween, said handle being elongated between said first end and said second end, said outer surface having a top side and a front side, said top side having a recess therein, said recess intersecting said front side, said recess being centrally positioned between said first end and said second end, said recess having a lower bounding surface, said recess defining a wall extending up from said lower bounding surface, said wall having straight outer portions and a curved medial portion extending between the straight outer portions, said straight portions being parallel and perpendicular to a central longitudinal axis of said handle, said first end having a first well extending toward said second end, said second end having a second well extending toward said first end, said top side having a first slot extending into said first well, said first slot being oriented collinear with said first well, said top side having a second slot extending into said second well, said second slot being oriented collinear with said second well;

a magnet being integrated into said lower bounding surface of said recess;

a ball marker being removably positionable in said recess wherein said ball marker is configured to be accessible to mark the location of a golf ball on a golf course, said ball marker having a bottom surface, said bottom surface abutting said lower bounding surface of said recess when said ball marker is positioned in said recess, said bottom surface being comprised of a magnetic material thereby facilitating said magnet to retain said ball marker in said recess, said ball marker having a thickness substantially equal to a depth of said recess wherein said ball marker is inset into said recess when said ball marker is positioned in said recess, said ball marker having a diameter substantially equal to a distance between said straight outer portions such that said ball marker is removable from said recess by sliding said ball marker laterally between said straight outer portions;

a divot fork being slidably coupled to said handle for lifting and repairing divots in the golf course, said divot fork being slidably positioned in said first welt, said divot fork having a pair of tines each being exposed when said divot fork is in a deployed position, each of said tines being retracted into said first well when said divot fork is in a stored position;

a fork button being coupled to said divot fork, said fork button extending through said first slot in said top side of said outer surface of said handle wherein said fork button is configured to be manipulated by a user, said fork button sliding said divot fork between said deployed position and said stored position;

a brush being slidably coupled to said handle for scrubbing implements for playing golf, said brush being slidably positioned in said second welt, said brush having a plurality of bristles each being exposed when said brush is positioned in a stored position, each of said bristles being retracted into said second well when said brush is positioned in a stored position;

a brush button being coupled to said brush, said brush button extending through said second slot in said top side of said outer surface of said handle wherein said brush button is configured to be manipulated by a user, said brush button sliding said brush between said deployed position and said stored position;

an engagement being coupled to said front side of said outer surface of said handle;

a coupler being removably coupled to said engagement, said coupler including a gate being hingedly integrated therein for opening and closing said coupler; and a towel being removably attachable to said coupler for wiping or cleaning an object, said towel having a grommet extending therethrough, said coupler being extendable through said grommet for attaching said towel to said coupler.

* * * * *